F3-441 SR
10/15/85 US 4,546,593

United States Patent [19]

Lasscock

[11] Patent Number: 4,546,593

[45] Date of Patent: Oct. 15, 1985

[54] PACKAGING

[76] Inventor: Ian M. Lasscock, 334 Henley Beach Rd., Lockleys, South Australia, Australia, 5032

[21] Appl. No.: 149,999

[22] Filed: May 15, 1980

Related U.S. Application Data

[63] Continuation-in-part of Ser. No. 941,860, Sep. 13, 1978, abandoned.

[51] Int. Cl.[4] ..... B65B 35/50; B65B 53/00; B65B 53/02

[52] U.S. Cl. ..... 53/441; 53/442; 53/447; 414/35; 414/97

[58] Field of Search ..... 53/441, 442, 443, 447, 53/438, 459, 529, 567, 587, 588, 585; 414/35, 97; 296/13, 36, 40

[56] References Cited

U.S. PATENT DOCUMENTS

| | | | |
|---|---|---|---|
| 1,043,824 | 11/1912 | Griffin | 296/13 |
| 1,122,849 | 12/1914 | Botteese | 296/36 |
| 1,353,351 | 9/1920 | Kuhnen | 296/13 |
| 1,413,868 | 4/1922 | O'Bryan | 53/459 X |
| 2,581,561 | 1/1952 | Shaw | 53/442 X |
| 3,825,113 | 7/1974 | Kramer | 53/442 X |
| 3,945,493 | 3/1976 | Cardinal | 53/442 X |
| 4,050,220 | 9/1977 | Lancaster | 53/588 X |
| 4,110,957 | 9/1978 | Lancaster | 53/588 X |

FOREIGN PATENT DOCUMENTS

| | | | |
|---|---|---|---|
| 2601885 | 7/1977 | Fed. Rep. of Germany | 53/442 |

*Primary Examiner*—John Sipos
*Attorney, Agent, or Firm*—Oldham Oldham & Weber Co.

[57] ABSTRACT

A method of forming and holding a stack of bags where the bags are of a type and filled with a material to be vulnerable to dislodgement if the stack is too high the method including the steps of confining the stack during the building of the stack by leaves projecting vertically up each side of the stack, tightening the sleeve around the stack thus built including the leaves, and then withdrawing the leaves.

There are further features of one of the leaves being dismountable in sections to assist in building the stack and the further step in the method for holding the leaves together by disposable cords to resist upper spreading of the leaves during the building of the stack.

13 Claims, 9 Drawing Figures

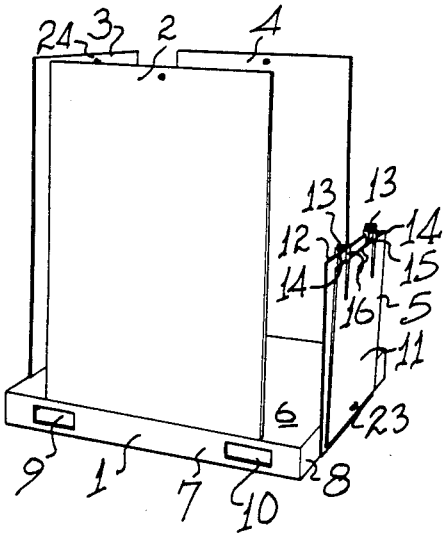
FIG 1
FIG 2
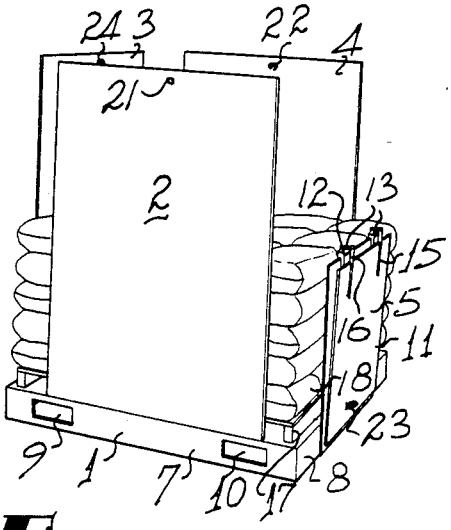
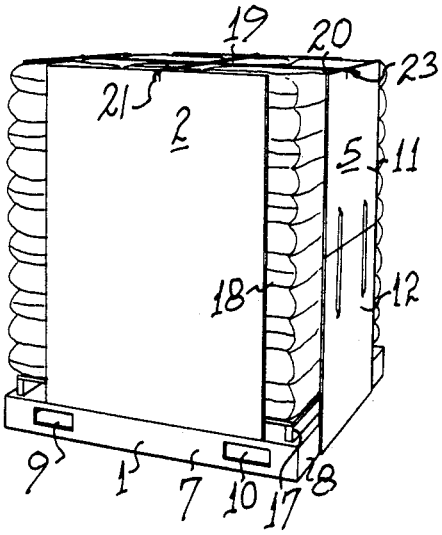
FIG 3
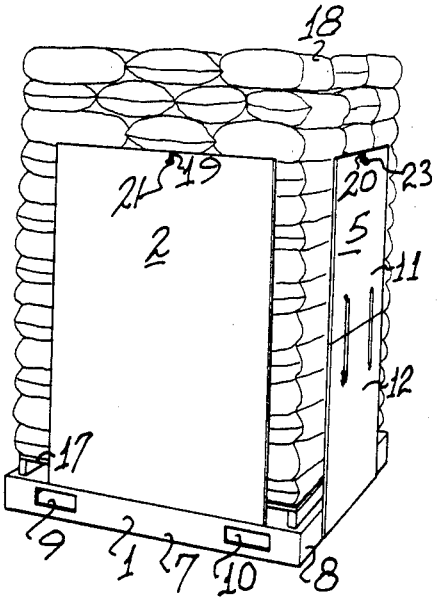
FIG 4

PACKAGING

This is a continuation-in-part of my prior application Ser. No. 941,860, filed Sept. 13, 1978 now abandoned.

This invention relates to a method of putting together a stack of bags for transporting this stack.

BACKGROUND OF THIS INVENTION

It is generally well known to store materials in plastic bags especially where the material is particulate material and the bags are convenient size for subsequent independent sale and for transport of such bags that such bags should be stacked in adjacent relationship on a standard pallet and in a crossing interleaved relationship row upon row to form a stack.

The present difficulty however, is generally related to the economics of transporting such stacks of bags.

It is at present found that the number of stacks that can be transported by a road vehicle is not limited by the all up weight of the stacks but is limited by the support area required by the stacks.

The economics of transporting such stacks then is limited in the main by the height that each stack can be stacked to.

To a certain extent, this can be limited by the pressure that can be applied on the bag which can be a function of the strength of the plastic used in the bag and the characteristic of the material but there has been found to be a much greater problem and that is that as these stacks are higher the bags which are simply held by frictional engagement are distorted in shape and are in effect pushed outwardly from the stack with greater force as the stack gets higher.

Such an effect seriously changes the shape of the stack and limits the all up height that a stack can be built to and being to a certain extent not able to be consistently determined, the all up height of any stack must be substantially limited for this reason only.

With such bags in a dislocated position in the lower part of the stack, this also leads to an unstable stack which means that the stack subsequently can be unstable and vulnerable to dislodgement when being transported recalling that the transport system will create substantial forces on any bags in the stack and at the present time then the cost of transporting stacks is limited directly by this problem.

The concept of this invention

This invention in general terms proposes a method of building a stack which uses additional apparatus to hold the shape of the stack and overcomes in general terms problems that have been experienced in such apparatus and proposes a method by which the whole stack can be held by a subsequently disposable means so that the stack can be built to be held while being built in a stable and vertically aligned way and subsequently can be held in this way for subsequent transport and more particularly this enables the height of any stack especially where supported on such items as a standard pallet to be somewhat higher without losing stability than otherwise has been the case.

The concept proposes using leaves or their equivalent such as fingers which project in a vertical manner and maintain the position of the bags as the stack is being built and are otherwise of such a shape and otherwise characterised so that the leaves can be subsequently withdrawn from any holding material such as shrink wrap plastic to leave the stack well held.

There are indeed a number of detailed problems that have been experienced and have in due course been overcome in carrying this concept out in practice and these will be described in detail and of course the invention can reside in any of these details Generally then there is proposed vertically projecting leaves adapted to have located therebetween a pallet or other base support and the stack of bags which are of course of a type subject to the problem described are then built in adjacent relationship and row upon row where subsequent rows are in a crossing interleaved relationship.

There is also included the step of providing a sleeve which engages around the stack once built and particularly around the leaves holding the stack in a vertical position against the somewhat substantial forces and the sleeve is tightencd so as to take up in effect the pressures supported by the leaves and the leaves are then subsequently withdrawn either by reason of the stack on its pallet being lifted vertically or conversely the leaves being withdrawn downwardly and in any event so as to leave the sleeve holding the stack.

Preferably the sleeve is formed simply by being the walls of an overall bag shaped member comprising shrink wrap plastic the floor of which forms an overhead portion over the stack, the whole being tightened over the stack by being heated in a conventional manner.

Because there are substantial forces when the stack is high, these can have the tendency of forcing even the strongest leaves outwardly and there has been found to be advantage in providing a means engaging an upper portion of each of the opposite located leaves until the stack is held by the subsequent sleeve and then when the leaves are to be withdrawn, disengaging such means.

Preferably the leaves have a gap therebetween and preferably this is above the corners of the pallet and the gap is sufficient firstly to allow a fork lift to lift the pallet and effect withdrawal of the leaves thereby and perhaps more importantly even, the corners have a tendency to grip most securely onto any shrink wrap plastic and this assists in grabbing the plastic in contradiction to any engagements of the shrink wrap plastic to the outer face of the leaves.

In the preferred example, the leaves are themselves supported on a base and there are four leaves one of which has two sections an upper section of which can be shifted in position so as to allow access there past for bags being loaded into an area between the leaves and subsequently the upper section can be located on the lower section and provide a leaf generally as strong as the other leaves.

Further aspects of the invention will be better understood when reference is made to the preferred embodiment and to claims appending to this specification.

Accordingly a preferred embodiment will now be described with the assistance of drawings in which, FIG. 1 is a perspective view of the leaves supported by a support base one of the leaves having an upper section supported by a hinge to the lower section and in the illustration shown in a lowered position, FIG. 2 is the same view as FIG. 1 this time however, showing a base pallet between the leaves and bags stacked to a first height there being shown five rows of bags and in each row the bags being arranged so as to be crossing at least some of the bags below and being generally in adjacent relationship to adjoining bags, FIG. 3 shows the next step in which the upper section of the one leaf is raised and the bags are further stacked to the height of the leaves so that there are now eleven rows and there is especially shown a cord extending between the upper portion of each of the leaves with an oppositely located upper portion of the other leaf to resist spreading;

FIG. 4 shows the further stacking of the bags, this showing a further three rows, FIG. 5 shows a bag of shrink wrap plastic being located fully over the stack now formed and the leaves and subsequent to the shrinking of this plastic by application of heat in a conventional manner;

FIG. 6 which is also the same view as FIG. 5 there is shown the forks of a fork lift truck being introduced adjacent to each side of the leaf and especially locating with the base pallet from whence the whole stack with the covering is lifted relative to the leaves and their base so as to leave a separately supported stack on its own pallet held in place by the shrink wrap plastic as is illustrated in FIG. 7;

DESCRIPTION OF PREFERRED METHOD IN DETAIL

Figure 5:
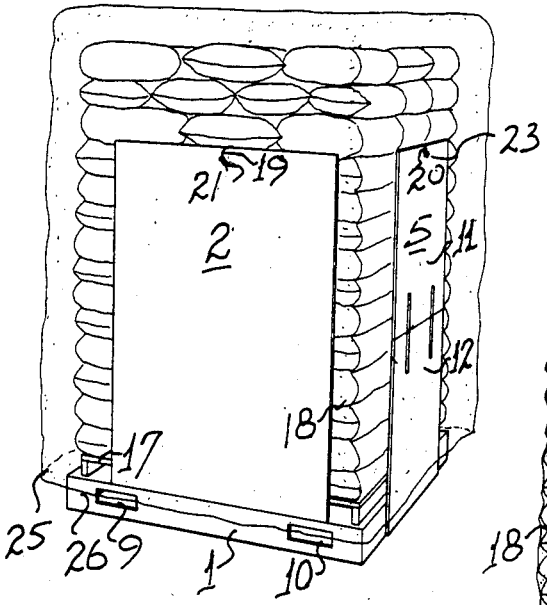

A base support is shown to which is received when the base support 1 is horizontal, four leaves 2, 3, 4, and 5, each of these leaves being made from a strong metal such as mild steel and being connected to the base support 1 in such a way as to give maximum strength to the positioning of each of the leaves.

The base support is comprised of a floor 6 and four sides 7, 8, and two sides of which are not shown but which are symmetrical with the sides shown and in side 7 and the oppositely located side not shown are two apertures 9 and 10 which enable the forks of a fork lift truck to enter into the base support 1 and lift the whole assembly.

Leaf 5 is constituted by two sections an upper section 11 and a lower section 12. These are joined together by a pivoted link system 13 an inner end of the link 13 in each case being connected to a rod 14 which slidably fits within matching bore 15 and there is furthermore a spigot 16 secured to the upper section 11 so that when the upper section is located at an uppermost position, the rod 14 will pass together with the link 13 into the bore 15 and the spigot portion 16 will also enter this portion and the upper section 11 will be locked in an uppermost position thereby.

The application of this invention is to bags and to a stacking of bags where each of the bags is of similar size and shape and is otherwise of a type and includes material there-in of a type where with such bags in a stack with substantially vertical sides and located in adjacent relationship with other of the bags to form a row, and in a crossing relationship to form an interleaved row upon row relationship there will be a force effective to force bags located at a lower portion of a stack and to a side of a stack out to a side of a stack reducing stability of a stack and alignment of the sides of a stack.

Illustrative of the type of bag and the filling of the bag material can comprise in this embodiment plastic especially polyvinylchloride sheet and the bag is generally filled with a deformable material such as particulate fertilizer or potting soil or of course any other similarly deformable material.

It is conventional and it is intended in this embodiment that the bags in each case be of the same size and generally of the same weight so that they are filled generally to the same degree and as shown in FIG. 2 a stack is made by first inserting a pallet 17 and then in sequence usually by having a person working within the area confined by the leaves 2, 3, 4 and 5 located row upon row and in each instance these bags are located so that they are in crossing relationship and generally the bags are adjacent to each other in any row. The bags are shown as 18.

Subsequent to the bags reaching a height as shown in FIG. 2, the upper section 11 of the leaf 5 is raised so that this leaf then becomes full height and the person working in the area as defined between the leaves then of course is somewhat higher because he can stand on the bags already stacked and in this case then will continue to build up the stack with bags upon bags until the height as shown in FIG. 3 is reached whereupon a cord 19 in one case and 20 in the other is tied between the respectively located upper portions of the leaves 2 and 4 in the one instance and 3 and 5 in the other by tying through the apertures 21, 22 in the case of 2 and 4 and 23 and 24 in the case of 3 and 5.

This has the effect of holding together the tops of the leaves where additional pressure will be caused by raising of the stack.

In FIG. 4 there is shown the stack being raised to an additional height of three rows.

In FIG. 5 is shown the shrink wrap plastic bag being placed over the stack as supported by the leaves and it will be noticed that the bag 25 is lowered so that a lower edge 26 is generally as low as at least the pallet 17.

Figure 6:
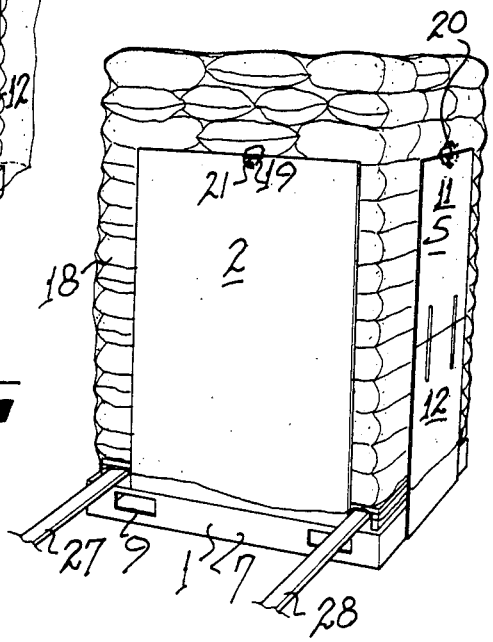

Hot air is then blasted onto the shrink wrap plastic until the plastic shrinks sufficiently to fully hold the stack as is shown in FIG. 6.

It will be noticed that the plastic especially grips the corners of the stack which are left clear by the shape and size of each of the leaves.

At this stage, the cords 19 and 20 are cut by passing a knife through the relative portion of the shrink wrap plastic which small tear will make no appreciable difference to the overall strength and then a fork lift truck, the forks of which are shown as 27 and 28 is used to engage and lift the stack relative to the leaves.

This results in the separation because of the all up weight of the leaves with their base support being sufficiently heavy to force the leaves to slide from between the shrink wrap plastic and the stack and it is perhaps a surprising discovery that the plastic can provide sufficient holding of the stack after the leaves are removed even with the removal of the bulk of the leaves.

Figure 7:
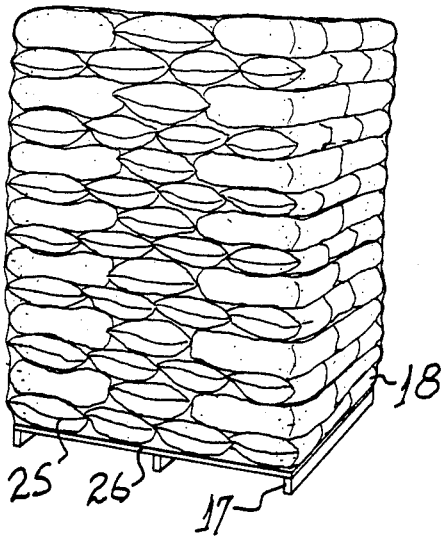
FIG. 7 is a view of the stack of bags with the shrunken film wrap thereon.

The stack as then built and held as is shown in FIG. 7 and located on a pallet is of higher proportions than has hitherto been possible and furthermore by reason of the way it is now held it can be transported with considerable stability and furthermore safety and it is furthermore very economic because of the higher height as.-compared to the area of the pallet to so transport.

This then describes the preferred embodiment.

At least in the wider concepts, it is not intended that the invention should necessarily be limited to the case where the leaves are themselves held to a fixed base but it is reasonable to provide other means by which the leaves can be supported and adjusted in position for instance that these can in themselves be supported by hydraulic ram and be raised or lowered relative to a supporting platform on which the stack can be built.

Throught the specification reference has been made to the word leaf as indicating the type of support that can provide the support on the side of the stack.

It is not intended that this word be a limiting definition in the sense of providing merely a planar member extending over a substantial proportion of the area of the side of the stack, but it could include one or more bars or fingers so that perhaps three or four fingers could replace the continuous planar shape of the leaf as shown and it would be considered that this will be well within the broader concept of this invention.

Throughout this specification the term "leaf" is not intended to limit the use of narrower members such as fingers and the word "leaf" is intended to include this concept.

The term "sleeve" is taken to mean a unitary enclosure such as a tube or a bag, or it may be a plurality of layers or convolutions of a plastic strip overlaid in spiral fashion upon each other to form an enclosure sleeve.

Figure 9:
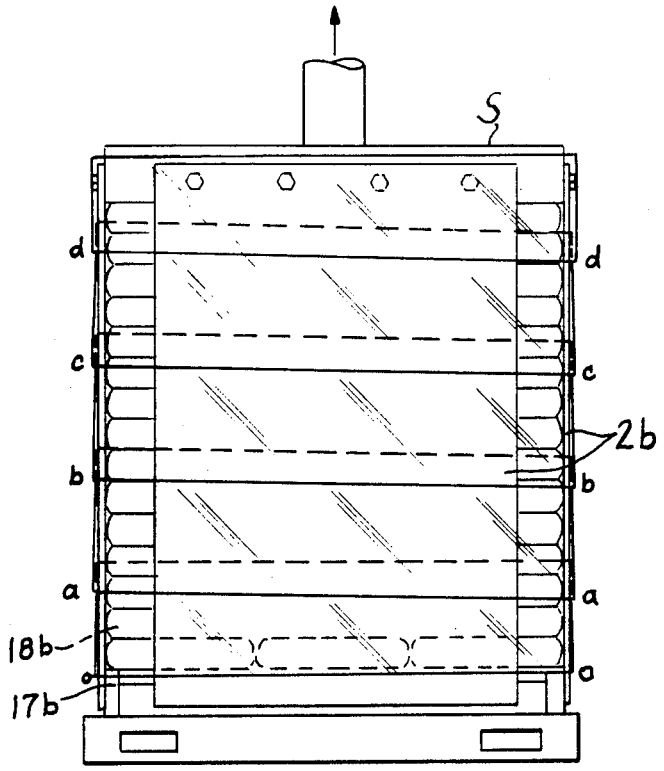
FIG. 9 is a diagrammatic view of a stack of bags as in FIG. 3, where the leaves are positioned by a member above the stack of bags and are removed after the stack has been formed.
Figure 8:
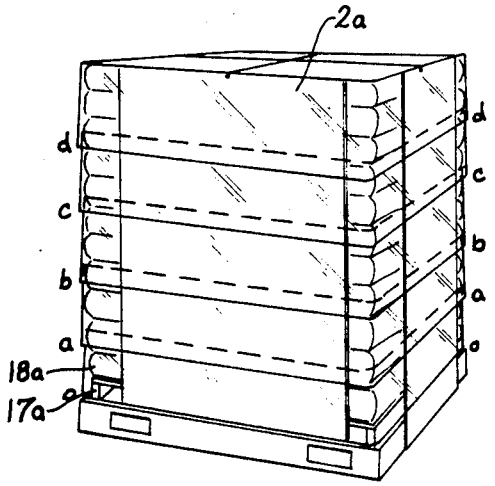
FIG. 8 is a view like FIG. 3, but showing how a strip of stretch wrap can be wound upwardly of a stack of bags around the assembly of the leaves and bags.

FIGS. 8 and 9 show how a strip of any suitable vinyl based plastic film that has a strong tendancy to adhere to itself can be manually wrapped around a stack of articles (bags) as formed in FIG. 3, under tension to form an enclosure sleeve that tightly engages the stack of bags. The film is conventional and "Glad-Wrap", a polypropylene, is one material that has been used, and it can be unwrapped from a roll and be applied around the assembly under substantially constant tension.

FIG. 8 shows how the film strip having lower edges indicated progressively at o—o, a—a, b—b, c—c, and d—d are applied to the assembly to build up an enclosure sleeve. Such sleeve normally engages the base 1*a* that positions sets of leaves 2*a* between which the articles are stacked, and the tensional sleeve tightly engages the exposed corners of the stacked assembly of the bags 18*a*. Any suitable plastic cover can be applied to the top of the bags shown in FIG. 8, usually after the leaves 2*a* are removed.

In FIG. 9, an upper support S is provided for the leave 2*b*, and it is movable vertically up to withdraw the leaves from the sleeve covered stack of bags 18*b*. The sleeve of FIG. 9 is applied as indicated for FIG. 8. Just one pair of opposed leaves 2*b* would usually initially be secured to the support S to depend therefrom to overlap a pallet 17*b* and enable the bags to be aligned in a stack. A third leave could be present as the stack is formed by entry from the remaining one edge of the support base. The fourth leave would be positioned on the upper support S before forming a suitable sleeve from a heat seal bag or an adherent plastic strip around the bag-leave assembly.

This sleeve of FIG. 9 is formed under tension of the plastic strip as wrapped around the bags to engage the corner areas of the bags tightly and retain them in position as the retainer leaves 2*b* are withdrawn. Such sleeve preferably engages the support base for the stack. A waterproof cover of suitable type can be added as by a plurality of cross strips with dependent ends on opposed sides of the bags. A retainer strip then could be wound around the upper side margins of the bags to hold the cover strips in position.

A moisture-proof overlap of the plastic strips is desirable in forming the enclosure sleeve.

The retainer leaves are thin and usually smooth surfaced whereby they can be withdrawn as a unit and leave a tensioned plastic bag or sleeve tightly engaging the stack of bags. The leaves have the corners of the stacked bags exposed.

It has been an object of the invention to form a tensioned sleeve around the assembly of the leaves and bags. Such sleeve engages the bags to retain them in position on a support means, usually at least partly covered by the sleeve, for storage and/or transit after the leaves 2, etc., are removed by relative motion of the leaves in relation to the plastic sleeve enclosed bag stack.

By the novel method and apparatus of the invention, stacks of bags can be snuggly secured to a carrier support base to be retained in a snug stacked assembly thereon. The tensioned enclosure sleeve is formed and engages the bags while the bags are retained in an aligned, snug stack by the retainer leaves whereby later removal of the leaves does not impair the stack of bags or loosen the enclosure sleeve. The methods of the invention are easily practiced and the objects of the invention have been achieved.

What is claimed is:

1. The method of forming and holding a stack of bags where each of the bags is of similar size and shape and is other wise of a type and include material therein of a type wherewith such bags in a stack with substantially vertical sides and located in adjacent relationship with other of the bags to form a row, and in a crossing relationship to form an interleaved row upon row relationship that will be effective to force bags located at a lower portion of a stack and at a side of the stack, out to the said side of the stack reducing stability of the stack and alignment of the sides of the stack, the method according to this invention being characterized by including the steps of (a) positioning a base pallet between vertically extending leaves located in adjacent relationship to each of four sides of the base pallet, (b) placing bags of said type on said base pallet in a manner whereby to form a stack constituted by the bags being in adjacent relationship with other bags to form a row, and in a crossing relationship to form an interleaved row upon row relationship, and further whereby at least the bags in the lower rows are confined by the said leaves, (c) locating and tightening a sleeve that extends around the stack including the leaves, (d) and withdrawing the leaves from between the sleeve and the stack to leave the stack tightly held by the sleeve.

2. The method of holding and forming a stack of bags as in claim 1 in which the sleeve is a shrink wrap plastic and the step of tightening the sleeve around the stack includes heating the plastic to effect the shrink wrap effect to obtain the final bond of the plastic to the stack.

3. The method as in claim 1 in which the sleeve is constituted by being the walls of a holding bag with a floor portion the method being further characterised in that the floor portion is located over the top of the stack and the holding bag is comprised of the shrink wrap plastic and the step of tightening the sleeve includes the steps of heating the plastic to obtain the shrink wrap effect including the said floor portion.

4. The method according to claim 1 in which the leaves are of less width than the side of the pallet and positioning the leaves to leave a gap extending the height of the leaves above each corner whereby the stack of bags will have each corner extending through the said gap whereby allowing the sleeve to grip, upon being tightened, directly each corner of the stack of bags and facilitate removal of the leaves from within the sleeve.

5. The method as in claim 1 in which at least one of the leaves includes two sections, an upper section removably supportable on a lower section, and the method of the invention including the further step of, with the upper section dismounted from the lower section, loading bags onto the stauk up to about the height of the said lower section, then mounting the said upper section in vertical alignment with the said lower section and loading additional bags in further alignment with the bags of the stack to build the stack to a greater height.

6. The method as in claim 1 in which there is the further step that means are extended between an engaging and upper part of each of the oppositely located leaves during the building of this stack to assist in holding the leaves against spreading, and prior to withdrawal of the leaves, but subsequent to tightening of the sleeve about the stack, separating the said means from engagement with the said leaves.

7. The method of forming and holding a stack of articles in which the articles are to be located in rows one upon the other and in interleaving fashion the method being characterized by including the steps of building the stack of articles between at least one pair of oppositely positioned confining leaves, a second pair of oppositely positioned confining leaves being provided in engagement with the stack, each of said confining leaves defining a vertical plane, positioning a tightened sleeve in its final position collectively around the assembly of the stack and the leaves thus formed, and then withdrawing the leaves after positioning the tightened sleeve around the stack by relative movement between the stack and the leaves to leave the sleeve holding the stack thus formed.

8. The method as in claim 7, in which there is the further step that means are extended between and engage an upper part of each of the pairs of oppositely located leaves during the building of this stack to assist in holding the leaves against spreading, and prior to withdrawal of the leaves, but subsequent to tightening of the sleeve about the stack, separating the said means from engagement with the said leaves.

9. The method according to claim 7, in which each of the leaves is supported by a common support base, and using leaves which are thin and are of less width than the sides of the support base and positioning the leaves so that a gap extending the height of the leaves remains above each corner whereby the stack of articles will have each corner exposed at the said gaps so that the tightened sleeve directly grips each corner of the stack of articles.

10. The method of forming and holding a stack of articles in which the articles are to be located in rows one upon the other and in interleaving fashion and are vulnerable to dislodgements to a side of the formed stack by reason of pressure from articles above in the stack the method being characterized by including the steps of building the stack of articles between two pairs of oppositely positioned vertically positioned confining leaves, positioning a tightened sleeve collectively around the stack thus formed and the leaves, and then withdrawing the leaves to leave the sleeve holding the stack thus formed; and at least one of the leaves includes two sections, an upper section removably supportable on a lower section, and the method of the invention including the further step of, with the upper section dismounted from the lower section, loading articles onto the stack up to about the height of the said lower section, then mounting the said upper section in vertical alignment with the said lower section and loading additional articles in alignment with the articles of the stack to build the same to a great height.

11. The method of forming and holding a stack of articles as in claim 10, wherein the step of removing all of the leaves occurs after the additional articles have been loaded onto the stack.

12. The method forming and holding a stack of articles in which the articles are to be located in rows one upon the other and in interleaving fashion the method being characterized by including the steps of buidling the stack of articles on a vertical axis between at least one pair of oppositely positioned vertically directed confining leaves, a second pair of oppositely positioned vertically directed confining leaves being provided in engagement with the stack, positioning a tightened sleeve collectively around the assembly of the stack and the leaves thus formed, and then withdrawing the leaves by relative movement between the stack and the leaves to leave the sleeve holding the stack thus formed and including winding a strip of plastic film around the periphery of the assembly of the stack and leaves to form the sleeve from overlapping convolutions of the film.

13. The method as in claim 12, in which the leaves are formed of planar metal sheets, and forming the leaves to size and positioning the leaves so that they do not occupy the full length of sides of a support for the leaves to leave corner areas of the stack exposed for engaging the sleeve.

* * * * *